United States Patent [19]

Dickey

[11] 4,375,191

[45] Mar. 1, 1983

[54] ONE-PIECE, ALL-PLASTIC REPRODUCING STAMP AND TROUGH HOLDING UNIT

[75] Inventor: Avis M. Dickey, LaGrange County, Ind.

[73] Assignee: Dickey, Inc., South Milford, Ind.

[21] Appl. No.: 231,224

[22] Filed: Feb. 2, 1981

[51] Int. Cl.[3] ..... B41K 1/04; B41K 1/54; B41K 1/58

[52] U.S. Cl. ..... 101/333; 101/405; 101/368

[58] Field of Search ..... 101/368, 333–335, 101/405–406, 398, 379; 15/210.5

[56] References Cited

U.S. PATENT DOCUMENTS

| | | | |
|---|---|---|---|
| 316,268 | 4/1885 | Horner | 101/333 |
| 1,879,982 | 9/1932 | Hardy | 101/333 |
| 2,159,697 | 5/1939 | Hardy | 101/398 |
| 2,621,419 | 12/1952 | Wold | 101/368 |
| 2,684,012 | 7/1954 | Hebert | 101/368 |
| 2,970,539 | 2/1961 | Griffin | 101/368 |
| 3,311,227 | 3/1967 | David et al. | 101/333 |
| 3,388,662 | 6/1968 | Ravreby | 101/405 |
| 3,408,932 | 11/1968 | Mucci | 101/368 |
| 4,030,414 | 6/1977 | McGuire | 101/368 |

FOREIGN PATENT DOCUMENTS

| | | | |
|---|---|---|---|
| 351134 | 4/1922 | Fed. Rep. of Germany | 15/210.5 |

*Primary Examiner*—William Pieprz

[57] ABSTRACT

The present invention relates to a new and improved economical one piece, rigid opaque plastic reproducing stamp for employment with inked stamp pad, a plurality of individual stamps or stamps of a series such as an office directive set utilizing a closed-end plastic, one piece singular or multiple parallel rank holding trough storage unit for side by side stamp deployment and having at one end a shallowly depressed stamping pad repository.

Without aperture or reverse side protrusion, the reproducing stamp is designed with digital holding depressions on each of two opposite sides of the solid or enclosed hollow base and with raised stamp face depicting picture, letter, numeral, symbol, word, or message. The holding trough storage unit if flat bottomed for desk top utilization or with one side edge extended sufficiently downward at right (90°) angle to the aforesaid flat bottom, thereby providing for shelf-type affixment to wall surface.

1 Claim, 7 Drawing Figures

ONE-PIECE, ALL-PLASTIC REPRODUCING STAMP AND TROUGH HOLDING UNIT

SUMMARY OF THE INVENTION

The primary object of the invention is to provide a new and improved reproducing stamp with trough holder storage unit of economical rigid opaque plastic material, preferably synthetic thermoplastic polymer and of one step manufacture, characteristics considerably reducing cost.

The second object of the invention is to further lower cost of manufacture in tooling and maintenance with the employment of the plastic process.

The third object of the invention is to provide for retention in storage of a plurality of individual reproducing stamps or reproducing stamps of a series such as office directive set and stamp pad in close proximity to the user.

A fourth object of the invention is to provide a reproducing stamp with trough holder storage unit requiring minimal packaging, storage, and at hand space.

A fifth object of the invention is to provide good quality reproduction and simplicity of employment.

BRIEF DESCRIPTION OF DRAWINGS

FIGS. 1 and 2 depict typical plastic reproducing stamp faces while

DESCRIPTION OF PREFERRED EMBODIMENTS

Figure 1:
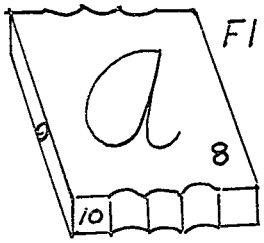
Figure 2:
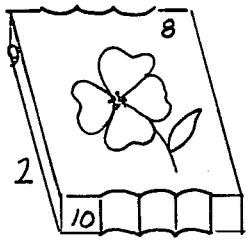
Figure 3:
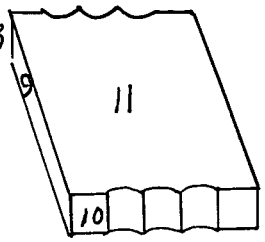
FIG. 3 is a planned view of a plastic stamp with digital holding depressions in readiness for stamping employment.
Figure 4:
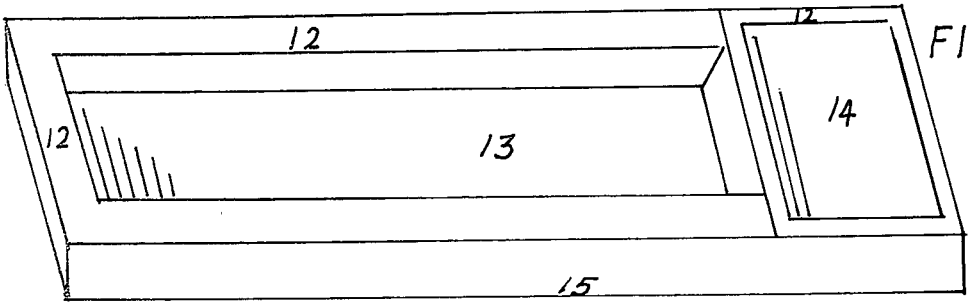
FIG. 4 is a planned view of a flat bottomed singular holding trough storage unit for desk top utilization and FIG. 5 is a drawing of the FIG. 4 unit with right-angled downward extension of side edge for shelf-type wall surface affixment.
Figure 5:
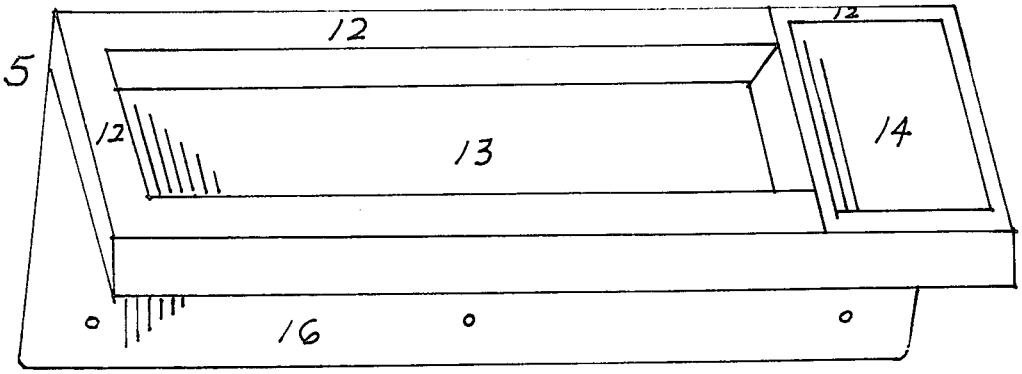
Figure 6:
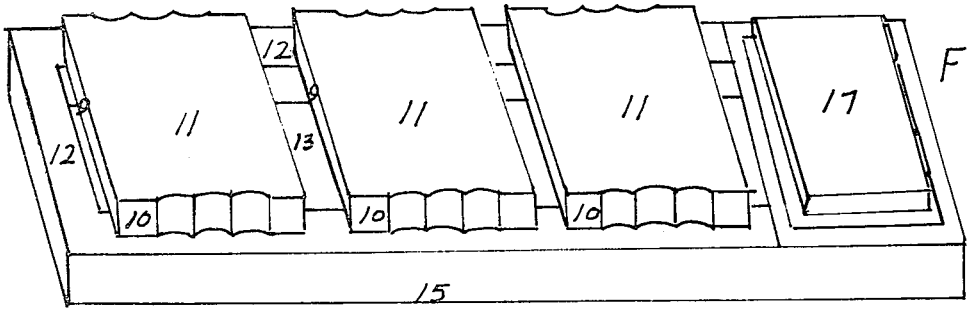
FIG. 6 depicts the FIG. 4 unit with ranked stamps and stamping pad in place.
Figure 7:
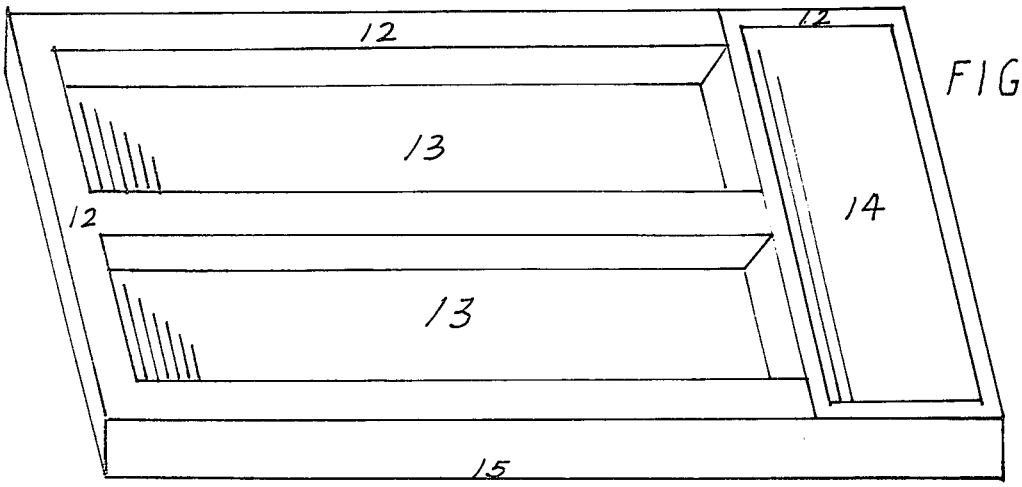
FIG. 7 shows the one-piece FIG. 4 unit employing multiple parallel holding troughs and flat bottom for desk top utilization.

Referring now more particularly to the drawings, FIGS. 1 through 3 depict varying views of typical manufactured of one piece, rigid, opaque plastic material, preferably synthetic thermoplastic polymer for economy stamps while FIGS. 4 through 6 picture plastic singular holding trough storage units of like manufacture. FIG. 7 shows a one-piece plastic multiple parallel rank holding trough storage unit, all FIGS. 4 through 7 showing end inked stamp pad shallowly depressed repository.

FIGS. 1 and 2 are planned views of raised and marginal areas of typical stamp faces 8 and relation of opposite digital stamp holding depression sides 10 to straight opposite stamp sides 9.

FIG. 3 depicts plastic reproducing stamp in stamping position, stamping face 8 downward, stamp reverse side 11 upward, and digital holding depressions 10 in readiness for grasping. The stamp face 8, digital holding depression sides 10, straight sides 9, and reverse stamp side 11 enclose either a solid or hollow stamp base as preferred.

FIG. 4 is a planned view of a singular holding trough storage unit with recessed center panel 13 and raised sides and end 12 coextensive in height to border of shallowly depressed ink stamp pad repository 14. The holding trough storage unit is designed with flat bottom 15 for desk top employment.

FIG. 5 depicts the planned view of the FIG. 4 holding trough storage unit with side edge 16 extended downward at right (90°) angle to the flat trough bottom 15 of FIG. 4 to provide for shelf-type affixment to wall surface.

FIG. 6 pictures the FIG. 4 singular holding trough storage unit with reproducing stamps of FIGS. 1, 2, and 3 in side by side deployment, stamp face 8 margins resting on holding trough raised sides 12, while inked stamp 17 pad rests in shallowly depressed repository 14.

FIG. 7 depicts the plastic one-piece holding trough storage unit with parallel rank holding troughs employed for a plurality of individual stamps or stamps of a series such as office directive set requiring more stamp rank spacing than provided by the singular holding trough unit FIG. 4.

I claim:

1. A unitized stamp set comprising, in combination:

(a) a plurality of generally rectangular reproducing stamps, each having upper and lower generally horizontal surfaces and generally vertical side surfaces extending between said upper and lower horizontal surfaces, each said upper horizontal surface being substantially flat; each said lower horizontal surface comprising a raised face containing the image to be reproduced by said stamp; an opposing pair of said vertical side surfaces being provided with a plurality of corrugated, rounded digital indentations which facilitate manipulation of said reproducing stamp; each said stamp being formed of a one piece rigid opaque synthetic thermoplastic material;

(b) a holding trough storage member having at least one elongated trough therein of a width smaller than the width of the individual reproducing stamps, said trough being bounded by a support surface so as to support said lower horizontal surfaces of a plurality of reproducing stamps in side by side relation with the ink receiving raised faces thereof extending into said trough and out of contact with the walls of said trough; said storage member also being provided with an ink pad member; said storage member being manufactured of a unitary, rigid, opaque, thermoplastic material and of a generally rectangular shape, one of the sides of said holding member being downwardly extended perpendicular to said reproducing stamp supporting surface of said storage member and being provided with means for attaching said extended side to a wall surface so as to enable said storage member to be affixed to a wall surface.

* * * * *